United States Patent [19]

Meyers

[11] Patent Number: 4,465,186

[45] Date of Patent: Aug. 14, 1984

[54] HOLDER FOR CLIPS

[76] Inventor: Jonathan H. Meyers, 140 Riverside Dr., New York, N.Y. 10024

[21] Appl. No.: 513,244

[22] Filed: Jul. 14, 1983

[51] Int. Cl.[3] ..... B65D 85/24; B65D 85/62; A44B 21/00

[52] U.S. Cl. ..... 206/342; 206/493; 206/499; 24/67.9

[58] Field of Search ..... 206/493, 342, 499, 337, 206/338; 24/67.9, 243 R, 255 GP, 81 A, 81 AG, 81 AT

[56] References Cited

U.S. PATENT DOCUMENTS

| | | | |
|---|---|---|---|
| 1,720,295 | 7/1929 | Schwartzman . | |
| 2,008,539 | 7/1935 | Begle | 206/493 |
| 2,370,417 | 2/1945 | Preston | 206/493 |
| 2,610,654 | 9/1952 | Ahlstrand | 206/493 |
| 3,462,803 | 8/1969 | Horton | 24/150 |
| 3,797,076 | 3/1974 | Watkin | 24/255 GP |
| 4,170,299 | 10/1979 | Clements | 206/342 |

FOREIGN PATENT DOCUMENTS

| | | |
|---|---|---|
| 1228878 | 9/1960 | France . |

*Primary Examiner*—William T. Dixson, Jr.

[57] ABSTRACT

The clips are received on spaced elements extending in parallel relation from opposite ends of a base such that sets of two side-by-side clips are situated in parallel planes. Spaced clip retaining elements extend in parallel relation from the intermediate portion of the base. The clips in each set are received between the clip retaining elements to prevent rotation thereof. A removable member is provided for preventing the displacement of the clips until use.

24 Claims, 5 Drawing Figures

HOLDER FOR CLIPS

The present invention relates to holders for clips and, more particularly, to a light-weight, inexpensive, and easily manipulatable holder designed primarily for use with "U"-shaped clips of the type which may be provided in connected pairs.

Plastic clips of the type which the present invention is designed to hold are sometimes referred to as "tie-back" clips and have substantially "U"-shaped bodies. Such clips are commonly composed of molded plastic material and may be provided with internal serrated edges to enhance the ability to grip an article. The clips are often provided in pairs connected to each other by an elastic or non-elastic string-like member. The ends of the string-like member are usually formed in loops and each loop passes through the opening of a different clip.

The clip pairs are used for a wide variety of different applications including the display, sale, and packaging of soft goods such as clothing and the like. Commonly, the clips are used to attach related articles to each other. For example, pairs of gloves, bathing suit tops and bottoms, or matching blouses and skirts, may be connected in this manner.

Clips of this type are a low priced item and must therefore be manufactured, packaged, and shipped as inexpensively as possible. Accordingly, any packaging for the clips must itself be low cost. In order to avoid increased shipping costs, the packaging must not add substantially to the weight or bulk of the item.

Aside from cost and weight considerations, packaging of clip pairs of this type presents certain problems due to the tendency of the interconnecting string-like members to become entangled. If the clip pairs are simply placed randomly in a carton, the string-like connecting members often become so entangled with each other that it becomes virtually impossible to remove the clip pairs from the carton one at a time. For this reason, various packaging techniques have been utilized in an attempt to prevent tangling and, thus, facilitate the use of this item.

One such packaging method has been to align the clips in side-by-side relation so as to form an assembly and, thereafter, wrap the assembly in heat-shrinkable plastic or the like. While this method stabilizes the individual clips during shipment, it has a disadvantage in that when the plastic wrapping is removed, the clips will fall randomly into a group and will then tangle as each clip pair is removed from the bunch.

An improvement on the above packaging method employs a pair of parallelly situated bars or the like. A group of clips is aligned such that one of the bars can be passed through the opening therein. Groups of aligned clips, with the bars inserted therein, are then placed in side-by-side relation and wrapped. While this method also stabilizes the clips during shipping, when the wrapping is removed, the groups of clips fall apart, are difficult to remove individually from the inserted bars, and still become entangled to some extent.

An attempt to further improve upon the above methods is disclosed in U.S. Pat. No. 4,170,299 issued Oct. 9, 1979 to Alan Clements and entitled "Rack and Tie-Back Clip Assembly." That patent teaches a rack which includes an end plate and a pair of spaced parallel extending bars mounted to the plate. A group of aligned clips is received over each of the bars by inserting the bar through the openings in the clips. The cross-sectional shape of the bar corresponds to the shape of the openings in the clips so as to reduce rotation of the clips relative to the bar. The groups of clips are situated adjacent to each other on the plate and a rubberband is wrapped around the clips and the plate during shipping.

In actual usage, it has been found that the rack of the above-mentioned patent does not function in an acceptable manner. Although the bar and the openings in the clips are correspondingly shaped, when the encircling rubberband is removed, the clips will still rotate to some extent with respect to the bars because sufficient clearance must be provided between the bar and opening to permit the clips to be inserted over and removed from the bars. In addition, the bars themselves are mounted to the end plate in a manner which permits considerable movement of the bars relative to the plate. Accordingly, once the band is removed, the bars and the clip groups thereon tend to separate, permitting the clips to rotate and move. Thus, while the idea of the use of an end plate to retain the end of the bars is an improvement, the configuration disclosed in the above-identified patent is, at best, only a partial solution to the problem.

It is, therefore, a prime object of the present invention to provide a holder for clips which is light in weight, inexpensive to manufacture, and, at the same time, easy to manipulate such that clip pairs may be removed therefrom, one at a time, without tangling, in a facilitated manner.

It is another object of the present invention to provide a holder for clips wherein movement of the clips relative to the clip receiving elements during shipping and removal of the clips is eliminated through the use of a simple and inexpensive and light-weight structure.

It is another object of the present invention to provide a holder for clips wherein rotation of the clips is prevented even after removal of the clip displacement preventing means.

It is another object of the present invention to provide a holder for clips which will continue to retain one of the aligned groups of clips, even after the other aligned group of clips has been removed.

It is another object of the present invention to provide a holder for clips which is composed of inexpensive, preferably injection-molded, plastic parts which cooperate together reliably.

In accordance with the present invention, a holder is provided for a group of clips of the type having a "U"-shaped body defining an opening. The holder comprises a base having a surface. Spaced clip receiving elements extend in substantially parallel relation from points proximate opposite ends of the surface. The clip receiving elements have substantially circular cross-sections and are adapted to be received within the openings of the clips such that sets of side-by-side clips may be situated in different planes substantially parallel to the base surface. Spaced clip retaining elements extend in substantially parallel relation from the base surface intermediate the ends thereof. The bodies of the clips in each set are received between the retaining elements such that rotation of the clips relative to the clip receiving elements is prevented. Removable means are provided for preventing displacement of the clips relative to the clip receiving elements.

The clip receiving elements may be permanently affixed to the base surface and are preferably formed integrally with the base. The clip retaining elements may be permanently affixed to the base surface and preferably are integrally formed with the base in a manner which permits one or both of the clip retaining means affixed to the base to be removed from the base by the user.

The base has a minor axis and a major axis. Preferably, the clip retaining elements are off-set with respect to the minor axis. Preferably, the clip receiving elements are situated on the major axis.

The base may have a substantially oval configuration. However, a base with a substantially rectangular configuration or other shape may also be utilized.

To these and to such other objects which may hereinafter appear, the present invention relates to a holder for clips as described in detail in the following specification and recited in the annexed claims, taken together with the accompanying drawings wherein like numerals refer to like parts, and in which:

Figure 1:
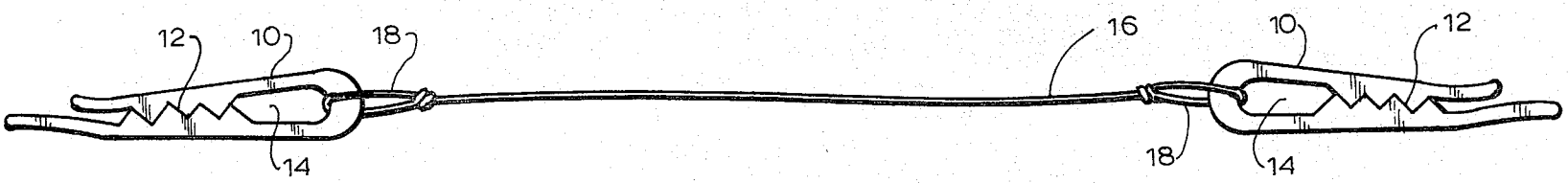
FIG. 1 is a top view of a pair of interconnected clips of the type which the present invention is designed to hold.

As shown in FIG. 1, the clips 10, which the present invention is designed to hold, have substantially "U"-shaped bodies with internal serrated edges 12. The body defines an opening 14 having an elongated configuration. The clips 10 are joined by an elastic or non-elastic string-like member 15 which has a loop 18 at each end. Each of the clips 10 is passed through a different one of the loops 18 such that a clip pair is formed.

Figure 2:
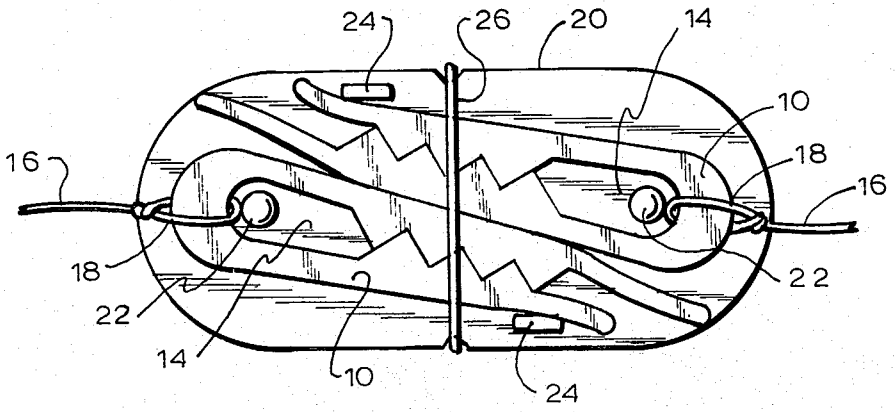
FIG. 2 is a top plan view of a first preferred embodiment of the present invention.
Figure 3:
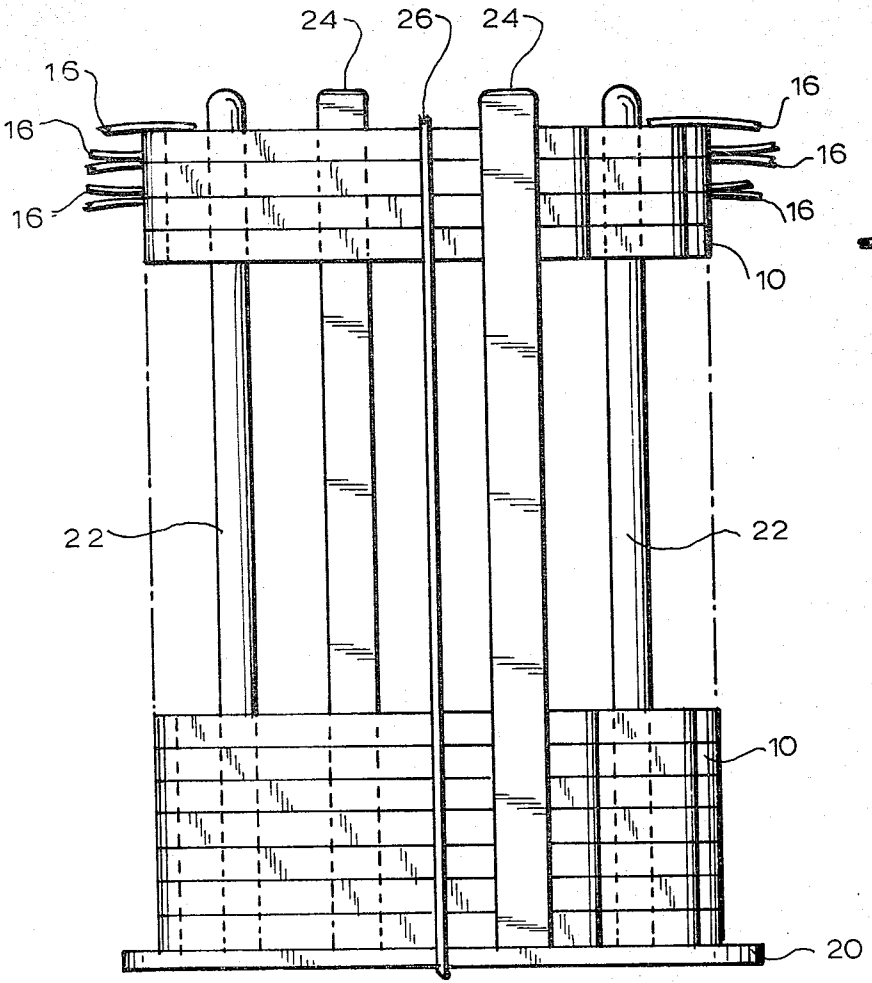
FIG. 3 is a side view of the first preferred embodiment of the present invention.

The first preferred embodiment of the holder of the present invention is illustrated in FIGS. 2 and 3. As shown in these figures, the holder of the present invention includes a base member 20 which is substantially planar and is illustrated as having an oval configuration. It should be understood that other base shapes, such as rectangular, may be equally useful.

Base 20 has a major axis (extending from left to right in FIG. 2) and a minor axis (extending from top to bottom in FIG. 2). Extending upwardly from the surface of base 20, offset from along the major axis and proximate to the opposite ends of base 20, are a pair of substantially parallel clip receiving elements 22. Elements 22 are mounted to base 20 in a substantially non-movable manner so that they will remain in a stationary position with respect to the base and each other. Elements 22 preferably have substantially circular cross-sections and are designed to be received within openings 14 of clips 10. The circular cross-sectional shape of elements 22 make elements 22 relatively inflexible.

Separate aligned groups of clips 10 are placed over each of the elements 22. A clip from one group will, thus, align with the corresponding clip in the other group such that the clips will be situated in sets of two side-by-side clips, each set being in a different plane substantially parallel to the surface of base 20.

Extending from the surface of base 20 are a pair of substantially parallel clip retaining elements 24, composed of relatively flexible plastic. Clip retaining elements extend from the intermediate portion of base 20, but are preferably off-set from the minor axis thereof. Clip retaining elements 24 are spaced apart such that the side-by-side clips in each set will be snuggly received therebetween. Elements 24 are illustrated in the drawings as having an elongated cross-section, but it should be understood that elements with other cross-sections may function equally as well. The elongated cross-section of elements 24 tend to enhance the flexibility thereof.

In order to prevent the clips from being displaced with respect to the clip receiving elements 22, a removable displacement preventing means is provided. In its simplest form, the removable preventing means takes the form of a band 26 which may be formed of elastic or non-elastic material. A common rubberband may be used for this purpose. However, a thin strip of heat-shrinkable plastic may also be used. Band 26 encircles clips 10 and the intermediate portion of base 20 as seen in FIG. 3.

When band 26 is removed, rotation of the clips relative to base 20 is still prevented by elements 24, even though the clips can now be removed from elements 22 as needed. This greatly facilitates manipulation of clips and, at the same time, permits retention of the clips on the base without tangling.

Figure 4:
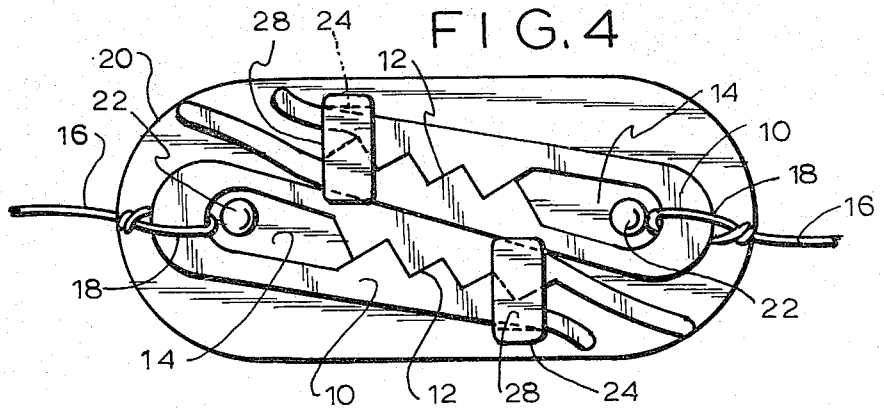
FIG. 4 is a top plan view of a second preferred embodiment of the present invention; and, FIG. 5 is a top view of the second preferred embodiment of the present invention showing a portion of the clips thereon being removed.

In the second preferred embodiment of the present invention, as illustrated in FIG. 4, band 26 is replaced by a pair of tabs 28 which extend from the free ends of elements 24, respectively, towards the major axis of the base, in a generally parallel relationship to each other and to the surface of the base. The clip bodies are engaged between the tabs 28 and the surface of the base. Tabs 28 serve to prevent clips 10 from being displaced relative to clip receiving elements 22 in the same manner as band 26.

Tabs 28 do not interfere with the insertion of the clips onto elements 22. As the clips are received on elements 22, elements 24 are simply flexed outwardly such that tabs 28 are out of alignment with the clip bodies. Thereafter, elements 24 are released, return to the original position, as illustrated in the drawing, and function to prevent displacement of the clips relative to the base. Similarly, during clip removal, elements 24 can be flexed outwardly to permit removal of the clips without interference from tabs 28.

Figure 5:
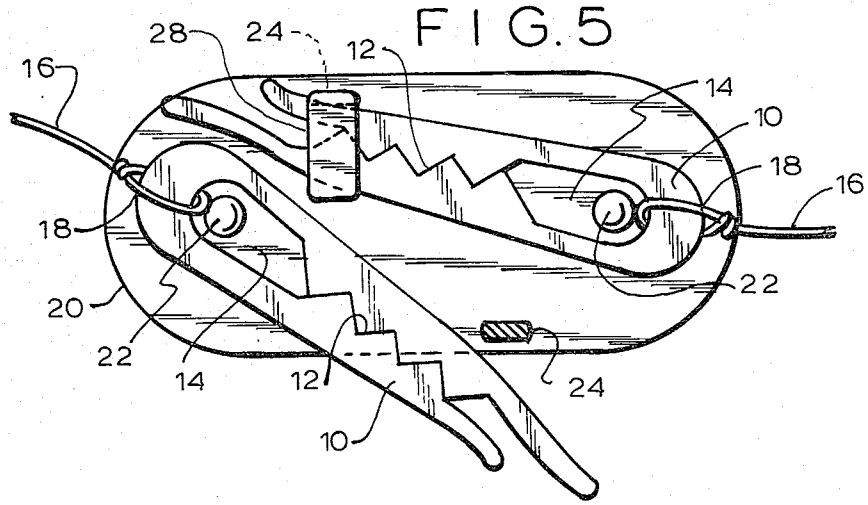

As illustrated in FIG. 5, the use of separate tabs 28 as a displacement preventing means has an advantage over the use of band 26 in that the elements 24 may be connected to base 20 in a manner which will permit same to be snapped off the base by extreme flexing. Each element 24 can be removed from the base separately, permitting one group of clips 10 to be removed from the holder while the other group is retained therein.

More specifically, after one of the elements 24 is removed from the base, one group of clips 10 can be rotated with respect to the clip receiving element 22 to which same is mounted, because of the circular configuration of the clip receiving elements 22, as illustrated in FIG. 5. The other group of clips remains in position on the base until required.

Preferably, base 20, clip receiving elements 22, and clip retaining elements 24 are formed of injection-molded plastic. Clip receiving elements 22 may be permanently affixed to the surface of base 20 in a substantially stationary or non-movable manner and are preferably integral therewith. Clip retaining elements 22 may also be permanently affixed to the surface of base 20, and integrally formed therewith. Alternatively, the bottom edge of each of the clip retaining elements 24 may be glued to the surface of base 20, or integrally molded therewith with perforations therein such that each of the clip retaining elements 24 can be individually snapped off of the base.

The use of removably mounted clip retaining elements 24 is particularly advisable when removal of each group of clips individually is desirable. Since each tabe 28 is affixed to the top end of the clip retaining element 24. the removal of the clip retaining element 24 will simultaneously cause the removal of the tab 28 attached thereto. Thus, the user can snap one of the clip retaining elements 24 from the base, rotate the adjacent group of clips and remove same from the base while the other group of clips remains frictionally engaged between the remaining tab 28 and the surface of the base. When appropriate, the other clip retaining element 24 can be removed and the remaining clips displaced with respect to the base.

In either embodiment of the present invention, it is possible to originally form base 20 with both elements 22 and a single element 24 thereon. Both groups of clips can then be inserted over elements 22 such that they are properly situated on base 20. Thereafter, the second element 24 can be attached to base 20 to complete the assembly. This method of putting the clips on the holder facilitates the assembly process, but has the drawback that the entire holder cannot be molded in a single step.

The bottom surface of base 20, that is, the surface opposite from which elements 22 and 24 extend, is flat. Elements 22 and 24 do not protrude therefrom. This permits the holder to stand upright on a planar surface, facilitating the removal of clips therefrom.

It should now be appreciated that the present invention relates to a holder for clips which requires minimum space, is light in weight and inexpensive to produce. The holder functions to prevent the tangling of the clips during shipment and facilitates the removal of clips when required. These objects are obtained through the use of relatively inflexible clip receiving elements of circular cross-section and a pair of flexible spaced clip retaining elements which are off-set from the minor axis of the base. Removable displacement preventing means are provided in the form of a band or parallel tabs extending from the free ends of the clip retaining elements in a direction substantially parallel to the surface of the base.

While only a limited number of preferred embodiments of the present invention have been disclosed herein for purposes of illustration, it is obvious that many variations and modifications could be made thereto. It is intended to cover all of these variations and modifications which fall within the scope of the present invention, as defined by the following claims:

I claim:

1. A holder for a group of clips of the type having a "U"-shaped body defining an opening, the holder comprising a base having a surface, spaced clip receiving elements extending in substantially parallel relation from points proximate opposite ends of said surface, said clip receiving elements being substantially non-movably mounted to said base and having substantially circular cross-sections, said clip receiving elements being adapted to be received within the openings of the clips such that sets of side-by-side clips may be situated in different planes substantially parallel to said surface, a first clip retaining element extending in substantially parallel relation to said clip receiving elements from said surface intermediate said ends thereof, the clips in each of said sets being receivable adjacent said retaining element such that rotation of the clips relative to said clip receiving elements is substantially prevented and removable means for preventing displacement of the clips relative to said clip receiving elements.

2. The holder of claim 1, further comprising a second clip retaining element extending from said surface in substantially spaced parallel relation to said first clip retaining element such that the clips are situated therebetween.

3. The holder of claim 1, wherein said clip receiving elements are permanently affixed to said surface.

4. The holder of claim 1, wherein said clip receiving elements are integral with said base.

5. The holder of claim 2, wherein said clip retaining elements are premanently affixed to said surface.

6. The holder of claim 2, wherein said clip retaining elements are integral with said base.

7. The holder of claim 2, wherein one of said clip retaining means is removably affixed to said base.

8. The holder of claim 2, wherein said base has a minor axis and wherein said clip retaining elements are off-set with respect to said minor axis.

9. The holder of claim 1, wherein said base has a major axis and wherein said points are situated on said major axis.

10. The holder of claim 1, wherein said displacement preventing means comprises a tab extending from the free end of said clip retaining element.

11. The holder of claim 2, wherein said clip retaining elements are relatively flexible.

12. The holder of claim 1, wherein said base has a substantially oval configuration.

13. In combination, a group of clips each having a substantially "U"-shaped body defining an opening and a holder for said clips, said holder comprising a base having a surface, spaced clip receiving elements extending in substantially parallel relation from points proximate opposite ends of said surface, said clip receiving elements being substantially non-movably mounted to said base and having substantially circular cross-sections, said clip receiving elements being adapted to be received within the openings of said clips such that sets of side-by-side clips may be situated in different planes substantially parallel to said surface, a first spaced clip retaining element extending in substantially parallel relation to said clip receiving elements from said surface intermediate said ends thereof, said clips in each of said sets being receivable adjacent said retaining element such that rotation of said clips relative to said clip receiving elements is substantially prevented and removable means for preventing displacement of said clips relative to said clip receiving elements.

14. The holder of claim 13, further comprising a second clip retaining element extending from said surface in substantially spaced parallel relation to said first clip retaining element such that the clips are situated therebetween.

15. The holder of claim 13, wherein said clip receiving elements are permanently affixed to said surface.

16. The holder of claim 13, wherein said clip receiving elements are integral with said base.

17. The holder of claim 14, wherein said clip retaining elements are permanently affixed to said surface.

18. The holder of claim 14, wherein said clip retaining elements are integral with said base.

19. The holder of claim 14, wherein one of said clip retaining means is removably affixed to said base.

20. The holder of claim 14, wherein said base has a minor axis and wherein said clip retaining elements are off-set with respect to said minor axis.

21. The holder of claim 13, wherein said base has a major axis and wherein said points are situated on said major axis.

22. The holder of claim 13, wherein said displacement preventing means comprises a tab extending from the free end of said clip retaining element.

23. The holder of claim 14, wherein said clip retaining elements are relatively flexible.

24. The holder of claim 13, wherein said base has a substantially oval configuration.

* * * * *